United States Patent [19]

Emrich et al.

[11] Patent Number: 4,723,489

[45] Date of Patent: Feb. 9, 1988

[54] DEVICE FOR TURNING OVER SHEETS IN ROTARY PRESSES

[75] Inventors: Helmut Emrich; Paul Abendroth, both of Offenbach am Main, Fed. Rep. of Germany

[73] Assignee: M.A.N.-Roland Druckmaschinen Aktiengesellschaft, Fed. Rep. of Germany

[21] Appl. No.: 907,499

[22] Filed: Sep. 15, 1986

[30] Foreign Application Priority Data

Sep. 17, 1985 [DE] Fed. Rep. of Germany ..... 3533081

[51] Int. Cl.[4] ..... B41F 5/02

[52] U.S. Cl. ..... 101/230

[58] Field of Search ..... 101/230, 231

[56] References Cited

U.S. PATENT DOCUMENTS

| | | | |
|---|---|---|---|
| 3,537,391 | 11/1970 | Mowry et al. | 101/230 X |
| 3,884,146 | 5/1975 | Ruetschle | 101/230 X |
| 4,165,689 | 8/1979 | Giuiuzza | 101/230 |
| 4,563,951 | 1/1986 | Mathes et al. | 101/230 X |
| 4,580,494 | 4/1986 | Becker | 101/230 |

FOREIGN PATENT DOCUMENTS

| | | | |
|---|---|---|---|
| 1148804 | 4/1985 | U.S.S.R. | 101/231 |

*Primary Examiner*—Clifford D. Crowder
*Attorney, Agent, or Firm*—Leydig, Voit & Mayer

[57] ABSTRACT

A device for turning over sheets in rotary presses of in-line construction, in which the impression cylinders of consecutive printing units cooperate with a single double-size transfer drum with which a storage drum is associated and gripper transfer facilities are provided which consist of cooperating rows of clamping grippers including fixed-position first-printing grippers cooperating with clamping grippers of the storage drum for turning the sheet over at the transfer drum, second-printing grippers which are adjustable with respect to the sheet format, and smoothing devices adjustable with respect to the sheet end are disposed after the clamping grippers on the storage drum as viewed in the direction of rotation.

4 Claims, 2 Drawing Figures

DEVICE FOR TURNING OVER SHEETS IN ROTARY PRESSES

FIELD OF THE INVENTION

The present invention relates generally to a device for turning over sheets in rotary presses of the in-line type and more particularly concerns sheet transfer facilitated by a transfer drum and a plurality of grippers whereby printing registry and non-smearing is ensured during the process of turning over freshly printed sheets.

One known sheet turning device of this kind is disclosed in DE-OS No. 2,633,183. However, using this device it is often impossible to obtain proper sheet register for the second printing with the sheet turning device provided. The transfer of the sheet edges for the perfecting process requires accuracy which cannot be obtained with the multi-pivot oscillating gripper transfer provided in the above patent (see FIGS. 7 to 9). In fact it has been found that the trailing sheet edge must not only be tightly held during transfer to the grippers, but the sheet must also be held taut while being placed on the storage drum surface. The multi-pivot oscillating gripper design used there between the transfer and storage drum is unsuitable for this purpose. Since the next sheet is already arriving before the preceding sheet has been taken away, the subsequent sheet must be routed to different paths (see FIG. 8). Also, there is a risk of the sheet smearing, in the transfer zone, on the multi-pivot oscillating gripper disposed beneath the sheet run.

Another sheet turning device is taught in DE-OS No. 2,625,750 which discloses associating the impression cylinders of consecutive printing units by means of a single transfer cylinder and turning the sheet over generally by cooperating rows of clamping grippers solely on the circumference of the transfer cylinder.

A disadvantage of this patent is that there is an increased risk of sheet smearing or set-off during the turning over process. The freshly printed sheet will still move uncontrollably despite being supported by the blown air. Thus, it is not possible to reliably prevent the freshly printed side of the sheet, which is initially inwards and in contact with the circumference of the transfer cylinder, from coming into contact with the circumference of the cylinder again after it has been lifted off. Moreover, this device does not include an additional storage drum suitable as a sheet guide during the first printing.

Another known device for turning over sheets in rotary presses of the in-line type is disclosed in DE-AS No. 2,305,132 in which the impression cylinders of consecutive printing units are associated by a single transfer drum and two pairs of gripper systems are provided for the turning operation. This system consists of two cooperating clamping gripper rows, each of which is arranged in half-circumferential offset relationship to the other on the impression cylinder which follows the transfer drum in the direction of conveyance. This device has smooth operating mechanical gripper transfer facilities but, to its disadvantage, requires that blowing or suction boxes be provided in the transfer zone of the transfer drum in order to prevent any smearing of the sheet on the drum, particularly smearing of the end of the sheet after the turning operation. The maximum effect for different paper format lengths can be obtained only if the suction or blowing boxes are controlled cyclically. A control system of this kind is not only expensive but also operates unreliably as the printing speeds increase. Also, this device does not have an additional storage drum suitable as a sheet guide during the first printing.

OBJECTS AND SUMMARY OF THE INVENTION

The primary aim of the present invention is to provide a sheet turning device of the kind referred to hereinbefore which allows not only reliable true-register sheet transfer from the storage drum but also completely obviates any risk of smearing or setoff in the following transfer zone.

Smearing and register problems are solved through use of a series of grippers on the drums and cylinders used in the device. To ensure reliable true-register and non-smear sheet transfer, fixed-position first-printing grippers on the transfer drum cooperating with clamping grippers on the storage drum are provided for turning the sheet over at the transfer drum. Second-printing grippers on the transfer drum are provided which are adjustable with respect to the sheet format. Finally, smoothing devices adjustable with respect to the sheet end are provided after the clamping grippers on the storage drum.

By these steps, it is not only possible to use just a single transfer drum and no suction grippers between two printing units but, in addition, perfect register is obtained with all types of printing stock, printing lengths and high printing speeds without any risk of smearing or set-off in the transfer zone after the turning operation. The use of double-size cylinders also provides smooth and gentle sheet running as is necessary for processing cardboard at maximum working speeds.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
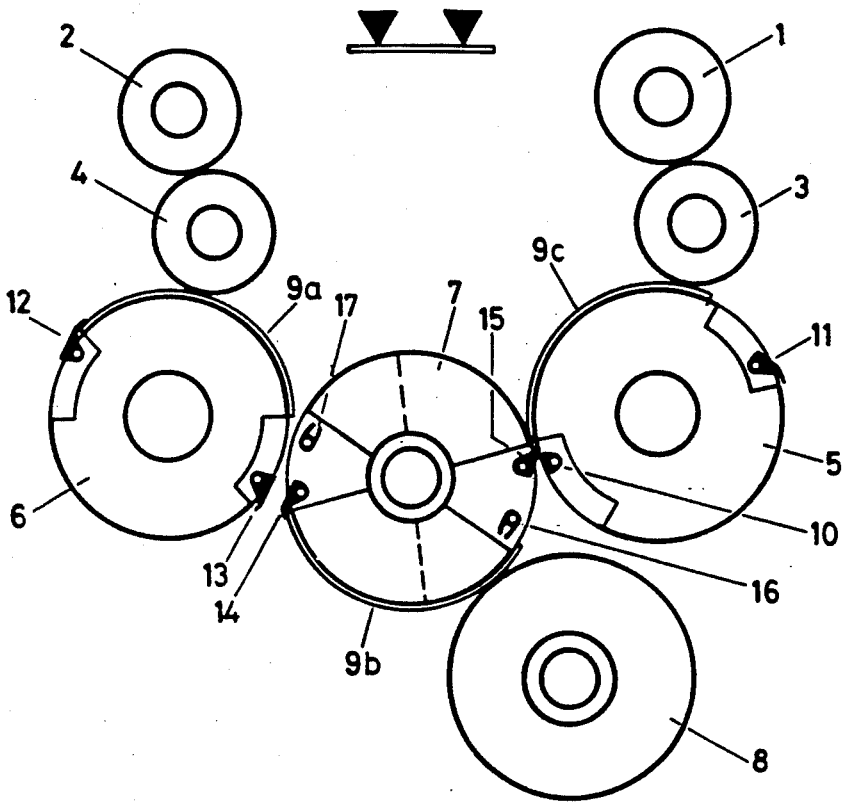
FIG. 1 is a somewhat diagramatic cross-section of sheet-fed offset rotary press with just one double-size transfer drum between double-size impression cylinders and an additional double-size storage drum, adjusted for the first printing operation.
Figure 2:
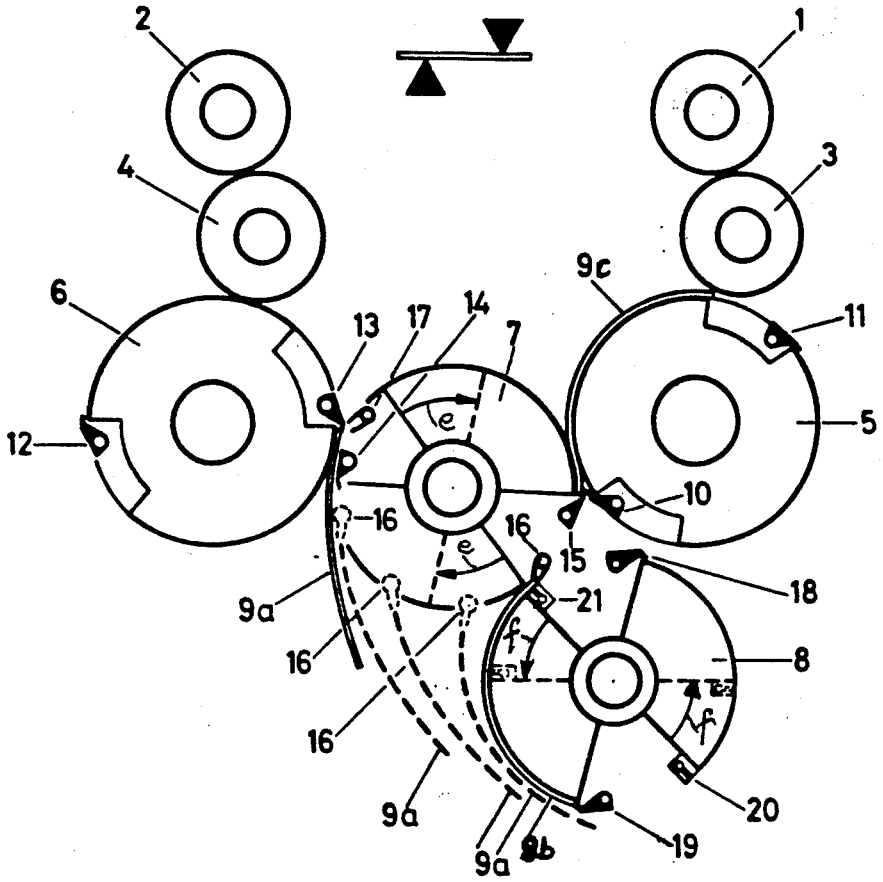
FIG. 2 is a cross-section of a sheet-fed offset rotary press similar to FIG. 1 adjusted for perfecting.

The two-color printing unit illustrated diagrammatically in FIGS. 1 and 2 consists of two plate cylinders 1, 2, two blanket cylinders 3, 4 and two double-size impression cylinders 5, 6 associated with just one double-size transfer drum 7. A storage drum 8 is additionally associated with the drum 7. The inking units at the plate cylinders 1, 2 are not shown.

The sheets to be printed are successively designated *9a*, *9b* and *9c* and are fed in known manner to the impression cylinder 5 and are taken off the impression cylinder 6. The cylinders 5, 6 are each provided with two rows of clamping grippers 10, 11 and 12, 13 which are situated opposite one another in known manner and with appropriate control are used to transport the sheets 9*a–c*.

For the first-printing the transfer drum 7 comprises two rows of first-printing grippers 14, 15. These grippers 14, 15 are arranged with a half-circumference offset from one another and cooperate with clamping grippers 10, 11 and 12, 13 on the impression cylinders 5, 6. At the same time, the storage drum 8 acts as an additional sheet guide drum for the first-printing since the gripper transfer function is out of operation. To enable the sheets 9*a–c* to be turned over, the transfer drum 7 also has second-printing grippers 16, 17 which are adjustable with respect to the sheet end, as shown by arrows e in FIG. 2. During the first printing operation the second-printing grippers 16, 17 are rendered inoperative, being pivoted into the interior of the cylinder of the transfer drum 7 (see FIG. 1).

During the first and second printing operations the first-printing grippers 14, 15 co-operate with clamping grippers 18, 19 on the storage drum 8. In these conditions the second-printing grippers 16, 17 do not come into operation until each sheet 9*a–c* bears completely against the associated part of the surface of the storage drum 8. To ensure that satisfactory contact is made between the rear edge of the sheets 9*a–c* and the storage drum 8 and that the second-printing grippers 16, 17 take over the sheet with accurate register, the storage drum 8 is provided with smoothing devices 20, 21 which are adjustable with respect to the sheet end, as shown by arrows f in FIG. 2.

As soon as one of the sheets 9*a–c* bears on the storage drum 8 in smoothed contact, its rear edge is reliably engaged by the second-printing grippers 16, 17. Only then is the front edge of the sheet released by the opening clamping grippers 18, 19 of the storage drum 8. The successive stages of sheet turnover are shown in broken lines in FIG. 2. It will be understood that the original rear edge of the sheet becomes the front edge and the sheet is transferred to the clamping grippers 12, 13 of the second impression cylinder 6 without any risk of smearing.

In the changeover to perfecting, the smoothing devices 20, 21 of the storage drum 8 are each adjusted with respect to the sheet end and the printing unit of the second impression cylinder 6 is so turned that the turned-over one of the sheets 9*a–c* is transferred to the clamping grippers 12, 13 of the impression cylinder 6 by the second-printing grippers 16, 17 adjusted to the sheet format. These second-printing grippers 16, 17, of course, may be in the form of known tongs-type grippers or known turnover type grippers.

In order to prevent the fixed-position first-printing grippers 14, 15 from coming into contact with the closed surface of the second impression cylinder, a known control device is provided to lower the first-printing grippers 14, 15 below the printing line in good time.

The invention is not restricted to the example described but can also be applied to a double-size transfer drum 7 between ordinary size impression cylinders. Similarly, the storage drum 8 may also be of the ordinary size.

We claim as our invention:

1. A device for turning over sheets in rotary presses having plural in-line printing units, in which single double-size transfer drum is interposed between the impression cylinders of consecutive printing units and a storage drum cooperates with the transfer drum, and gripper transfer facilities are provided which consist of cooperating rows of clamping grippers, characterized in that fixed-position first-printing grippers are provided on the transfer drum cooperating with clamping grippers on the storage drum for turning the sheet over, and second-printing grippers are provided on the transfer drum which are adjustable with respect to the sheet format, and smoothing devices adjustable with respect to the sheet end are provided on the storge drum after the clamping grippers as viewed with respect to the direction of rotation.

2. A sheet turning device according to claim 1, characterized in that the second-printing grippers are in the form of tongs-type or turnover-type grippers.

3. A sheet turning device according to claim 1, characterized in that the fixed-position first-printing grippers are mounted so as to be movable below the printing line in the region of the second impression cylinder.

4. A sheet turning device according to claim 2, characterized in that the fixed-position, first-printing grippers are mounted so as to be movable below the printing line in the region of the second impression cylinder.

* * * * *